United States Patent [19]

Tusinski et al.

[11] 4,392,334

[45] Jul. 12, 1983

[54] FLUID DISPERSING APPARATUS FOR USE IN PRODUCING OPHTHALMIC LENSES

[75] Inventors: Joseph Tusinski; Phillip D. Hill, both of Muskogee, Okla.

[73] Assignee: Coburn Optical Industries, Inc., Muskogee, Okla.

[21] Appl. No.: 208,376

[22] Filed: Nov. 19, 1980

[51] Int. Cl.[3] ..... B24B 57/00; B24B 55/02

[52] U.S. Cl. ..... 51/263; 51/266; 51/322

[58] Field of Search ..... 51/263, 266, 281 R, 51/322, 317

[56] References Cited

U.S. PATENT DOCUMENTS

| | | | |
|---|---|---|---|
| 1,063,434 | 6/1913 | Hachmeister | 51/263 |
| 2,663,127 | 12/1953 | Hunt | 51/263 |
| 3,466,811 | 9/1969 | Suddarth | 51/266 |
| 3,683,562 | 8/1972 | Day | 51/263 |
| 3,686,796 | 8/1972 | Clark | 51/3 |
| 3,732,647 | 5/1973 | Stith | 51/54 |
| 3,860,399 | 1/1975 | Noble et al. | 51/283 |
| 3,899,426 | 6/1975 | Blum | 51/55 |
| 4,031,671 | 6/1977 | Frosz | 51/263 |
| 4,185,609 | 1/1980 | Petera | 51/263 |
| 4,203,259 | 5/1980 | Haddock | 51/101 LG |

*Primary Examiner*—Roscoe V. Parker

*Attorney, Agent, or Firm*—John J. Byrne; Bradford E. Kile

[57] ABSTRACT

A method and apparatus for handling and dispersing a coolant and/or working fluid in ophthalmic lens processing equipment and the like. The apparatus includes a dispersing member (50) including a landing surface (52). An extension strip (62) projects away from the landing surface and includes a leading edge (64) having a compound arcuate contour. In operation a columnar flowing fluid (60) is directed onto the landing surface where it is spread into a sheet of flowing fluid (80). The sheet of fluid is guided away from the landing zone and onto working members operably intended to receive the fluid.

5 Claims, 6 Drawing Figures

FIG.1
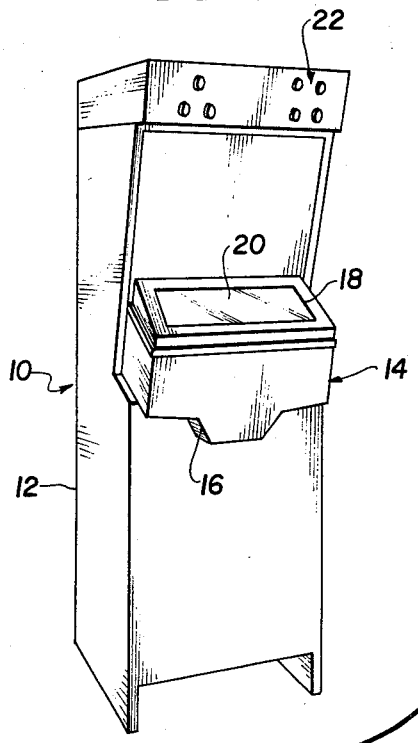
FIG.3
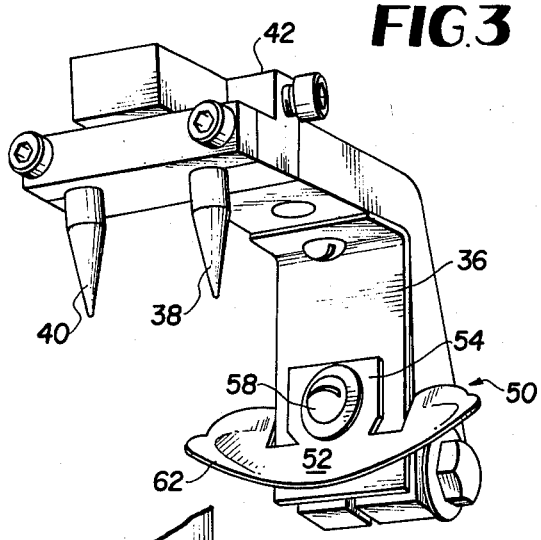
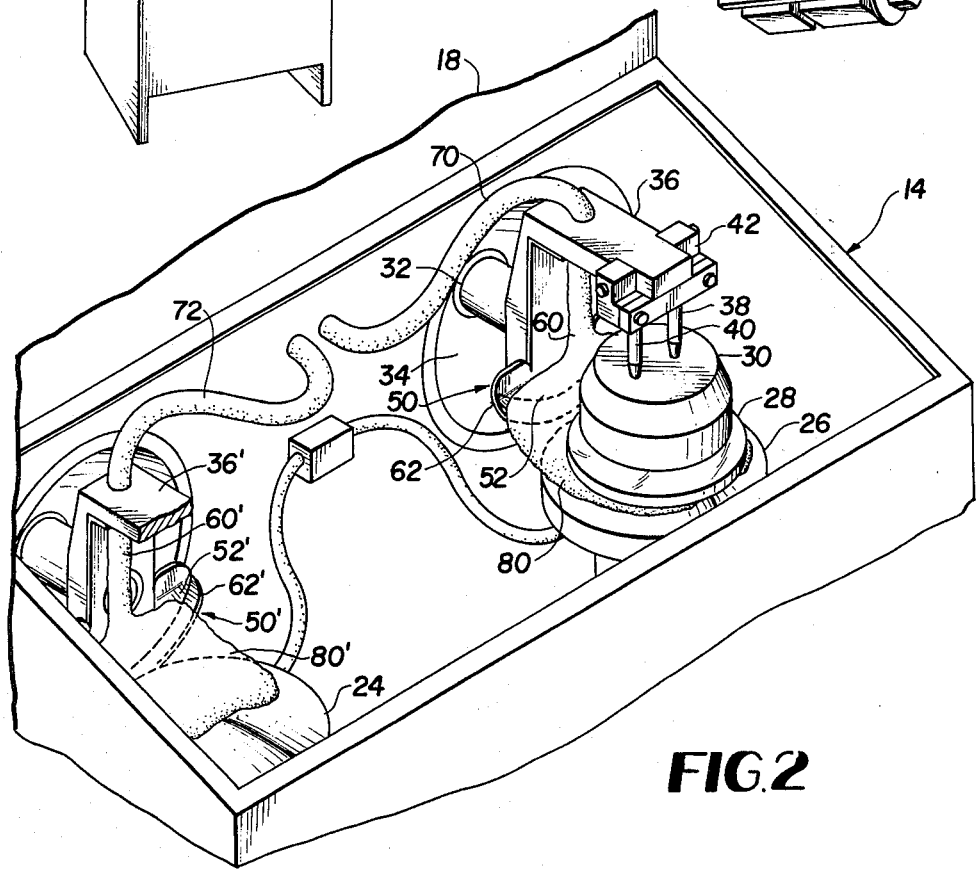
FIG.2

FLUID DISPERSING APPARATUS FOR USE IN PRODUCING OPHTHALMIC LENSES

DESCRIPTION

Technical Field

This invention relates to a method and apparatus for advantageously handling a coolant and/or abrasive working fluid in ophthalmic lens processing equipment. More specifically this invention relates to a method and apparatus for dispersing a columnar flowing fluid into a generally defined sheet of flowing fluid for use in ophthalmic lens processing equipment, machines and the like.

In the formation of an ophthalmic lens, a lens disc or blank is first molded from glass or plastic. This blank is typically fashioned with a convex surface on one side and a concave surface on the other. In order to process the lens to a desired prescriptive value, the lens is then mounted upon a lens generator where a rotating grinding cup, mounted at an angle to a central longitudinal axis of the lens, is swept across the lens to produce a toroidal surface of compound prescriptive value. Illustrative examples of such lens generating equipment may be had by reference to U.S. Pat. Nos. to Coburn 2,806,327; Suddarth 3,449,865 and Suddarth et al. 3,458,956; all assigned to the assignee of the subject application.

Following the initial generating operation, the ophthalmic lens is fined and polished to a final prescriptive value (note for example U.S. Stith Pat. No. 3,732,647). Left and right lenses are then mounted upon an edge grinding machine to cut the outer peripheral shape required of the lens in order to be compatible with eye glass frames. In this connection illustrative examples of edging machines may be found by reference to U.S. Pat. Nos. to Grey et al. 3,121,979; Novak 3,555,739; Haddock 4,027,434 and Haddock 4,203,259; again all assigned to the assignee of the instant application. Finally, the lens edge surfaces may be fine polished or honed to be smooth and free from scratches and/or other aberrations.

In each of the above noted processing operations it is desirable to bathe the working member and lens surface with copious quantities of a coolant and/or abrasive working solution. In the past coolant has been delivered to a working zone by a plurality of tubular conduits, with or without nozzles. An example of such a coolant distribution system is depicted in U.S. Suddarth Pat. No. 3,466,811; again assigned to applicants' assignee.

While coolant distribution systems of the above noted type have been widely utilized, room for significant improvement remains. More specifically, a problem often arises in connection with directing and dispersing a flow of coolants or polishing media most effectively. Using manifolds and/or multiple spouts, the nature of the media is such that clogging occurs which changes flow rates in an unpredictable manner. Moreover nozzles tend to produce an uneven slurry distribution pattern which can adversely affect the results of a lense processing operation.

The difficulties suggested in the proceeding are not intended to be exhaustive, but rather are among many which may tend to reduce the effectiveness and user satisfaction of prior coolant and/or working fluid dispersing methods and apparatus. Other noteworthy problems may also exist; however, those presented above should be sufficient to demonstrate that fluid dispersing techniques appearing in the past will admit to worthwhile improvement.

OBJECTS OF THE INVENTION

It is therefore a general object of the invention to provide a novel fluid dispersing method and apparatus which will obviate or minimize difficulties of the type previously described.

It is a particular object of the invention to provide a novel fluid dispersing method and apparatus wherein the delivery of copious quantities of a coolant or working fluid may be advantageously delivered to a working zone.

It is another object of the invention to provide a novel fluid dispersing method and apparatus which will be relatively free from clogging in an operating environment.

It is a further object of the invention to provide a novel fluid dispersing method and apparatus wherein copious bathing of a working zone with a coolant or working fluid may be achieved while concomitantly reducing the proximity and the number of fluid delivery conduits with respect to a working zone.

It is yet a further object of the invention to provide a novel fluid dispersing method and apparatus wherein delivery of a high volume of a coolant or working fluid to a working zone may be achieved without relying on an increase in velocity of fluid delivered through coolant directional nozzles.

BRIEF SUMMARY OF A PREFERRED EMBODIMENT OF THE INVENTION

A preferred embodiment of the invention, which is intended to accomplish at least some of the foregoing objects, comprises a coolant dispersing member, operable to be mounted within an ophthalmic lens processing machine, and the like. This member receives a generally columnar flowing coolant or working fluid and redirects and spreads the coolant into a flowing sheet and directs the sheet toward a working surface.

The method includes the steps of directing a column of flowing coolant or slurry onto a landing member position at an angle with respect to a central longitudinal axis of the column of slurry and thereby spreading the columnar flowing slurry into a flowing sheet. The method further includes the step of guiding the fluid sheet away from the landing zone toward a working member operably intended to receive the coolant working fluid.

BRIEF DESCRIPTION OF DRAWINGS

Other objects and advantages of the present invention will become apparent from the following detailed description of a preferred embodiment thereof taken in conjunction with the accompanying drawings, wherein:

FIG. 1 is an axonometric view of an ophthalmic lens polisher/finer apparatus operable to advantageously utilize a coolant or working fluid disperser in accordance with the subject invention;

FIG. 2 is a partial axonometric view looking into a working chamber of the polisher-finer machine and discloses a dispersing member in accordance with a preferred embodiment of the invention which is operable to receive a columnar flow of slurry, change the slurry into a flowing sheet and direct the sheet of fluid onto an ophthalmic lens and lens fining tool;

FIG. 3 is s detailed axonometric view of a fluid dispersing member in accordance with the invention connected to a lens mounting tool;

DETAILED DESCRIPTION

Figure 4:
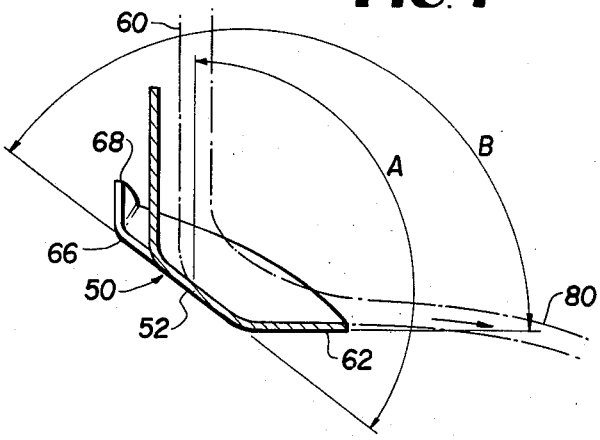
FIG. 4 is a detailed cross-sectional view of the fluid dispersing member in accordance with a preferred embodiment of the invention.
Figure 5:
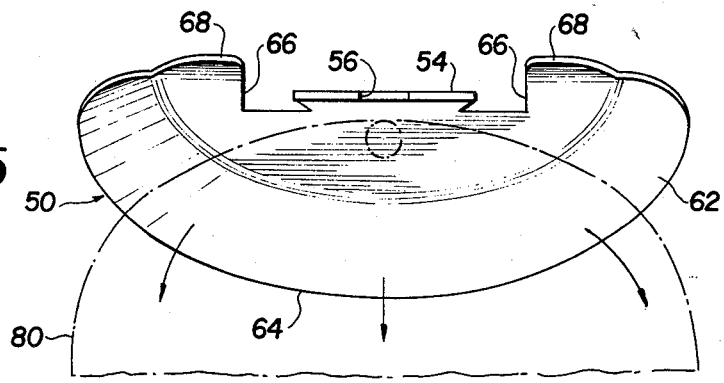
FIG. 5 is a plan view of the fluid dispersing member disclosed in FIG. 4.
Figure 6:
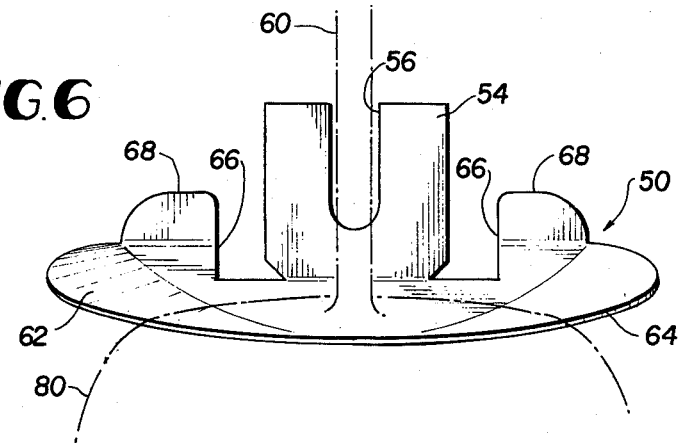
FIG. 6 is a front view of the fluid dispersing member depicted in FIGS. 4 and 5.

Prior to describing the subject invention in detail it may be worthwhile to briefly establish a typical operating context of the invention. In this connection FIGS. 1 and 2 disclose a polisher-finer apparatus 10 which, as previously outlined, is one of the units which may be used by an optics laboratory during a lens processing operation.

Structurally the polisher-finer apparatus 10 includes a generally upright frame 12 and a working enclosure 14 mounted generally at a mid point of the apparatus. The working enclosure includes a fluid or coolant catch basin 16 and a lid 18 having a transport window 20. The apparatus further includes a closed loop working fluid or coolant system, an air pressure system and an electrical system (not shown). These systems are controlled and monitored by an array of gauges and control switches 22 which are within the purview of one skilled in the art.

In operation, an operator desiring to finish a pair of ophthalmic lenses will lift the cover 18, note particularly FIG. 2, and insert lapping tools 24 and 26 onto left and right orbital, break-up drive assemblies (not shown). A more complete description of the orbital drive assemblies may be had by reference to previously noted U.S. Stith Pat. No. 3,732,647. The lapping tools 24 and 26 are selected to have a convex toric configuration compatible with the concave shape of the lens to be finished.

A right lens 28 and lens block 30 are then positioned upon the upper surface of the lapping tool 26. A left lens has been deleted from FIG. 2 in order to show structural details of the subject dispersing invention. A drive arm 32 extends into the working chamber 14, through a resilient baffle wall 34, and carries a mounting arm 36 which in turn supports a pair of block engaging retention pins 38 and 40 via an adjustable connecting member 42. As detailed in the Stith patent the arm 32 serves to bias the lens 28 into engagement with the lap head 26 and further provide a relative motion of the lens 28 with respect to the lap head 26.

In order to facilitate polishing action between the lens and lap and to cool the members, a fluid or coolant containing an entrained polishing compound is sprayed onto the working members, collected in the catch basin 16 and recycled.

The subject invention is specifically directed to an advantageous method and apparatus for dispersing the fluid in the lapping chamber and at other processing equipment stations where a coolant and/or working fluid is desired.

Referring now to FIGS. 3–6 there will be seen various detail views of the subject dispersing structure. A dispersing member 50, in accordance with a preferred embodiment of the invention, includes a generally planar sheet member or landing surface 52. The landing surface may be operably mounted adjacent a work station by a mounting member 54 which is either punched or slotted, as at 56 to operably receive a threaded fastener 58 or the like which may be turned into the mounting arm 36.

The landing surface 52 is slightly concave and is operable to be mounted at an obtuse angle A, note FIG. 4, with respect to a columnar flowing stream of fluid 60.

An extension strip 62 extends away from said landing surface 52 at an obtuse angle B with respect to the landing surface and generally in a direction of intended flow of the fluid. The extension strip 62 is fashioned with an arcuate front edge 64 when viewed in plan and front views, note FIGS. 5 and 6 respectively.

A containment member 66 extends away from the landing surface 52 in a direction opposite to the intended direction of flow of the fluid and on opposite sides of the mounting member 54. A lip 68 extends upwardly from the containment member 66 on each side of the mounting member and serves to prevent fluid from flowing away from an intended working station.

In operation a coolant or working fluid slurry is pumped through supply conduits 70 and 72 to right and left lapping heads respectively, note FIG. 2. The supply conduits 70 and 72 extend into apertures fashioned through the right and left mounting arms 36 and 36′ respectively. The previously mentioned fluid delivery system pumps a slurry through the conduits and generally columnar flowing streams of fluid 60 and 60′, emerge and continuously flow downwardly from the mounting arms in a posture approximately parallel with imaginery central longitudinal axes of lens to be lapped. The columns of fluid are directed by the apertures onto landing surfaces 52 and 52′ of the right and left dispersing members 50 and 50′.

The landing surfaces are sloped with respect to the columnar flowing fluid and serve to convert the columnar streams into sheets of flowing fluid 80 and 80′.

The fluid is attracted to the landing surfaces 52 and 52′ and the compound arcuate extension strips 62 and 62′ such that the sheets 80 and 80′ of fluid are effectively guided and leave the dispersing members 50 and 50′ with generally well defined lateral edges. The containment members 66 restrain rearward flow of slurry such that the entire column of fluid is essentially delivered from the landing zone onto the working surface.

As depicted in FIG. 2 the flowing sheets of fluid 80 and 80′ stream onto and facilely spread around the lapping heads 24 and 26 to copiously drench the working areas with the working fluid.

SUMMARY OF MAJOR ADVANTAGES OF THE INVENTION

After reviewing the foregoing description of a preferred embodiment of the invention, in conjunction with the drawings it will be appreciated by those skilled in the art that several distinct advantages of the subject dispersing method and apparatus are obtained.

Without attempting to detail all of the desirable features of the invention, as specifically and inherently disclosed above the conversion of columnar flowing fluid into a sheet enables a high volume of fluid, at a relatively low velocity, to copiously bathe working members during a processing operation.

The subject dispersing method and apparatus achieves enhanced bathing of the working members while concomitantly reducing the number of conduits and/or nozzles precariously mounted in a zone of rapidly moving working members.

The unique structural arrangement of the extension strip with a compound arcuate leading edge serves to advantageously direct the sheet of fluid and provide a flowing sheet with generally well defined lateral surfaces.

The containment member, including lip means, serves to constrain rearward movement of the column of fluid and acts in cooperation with the sloping landing area to direct substantially all of the fluid slurry toward the working members.

In describing the invention, reference has been made to a preferred embodiment. Those skilled in the art, however, and familiar with the disclosure of the subject invention, may recognize additions, deletions, modifications, substitutions and/or other changes which will fall within the purview of the subject invention.

We claim:

1. A fluid dispersing apparatus operable for use in ophthalmic lens producing machines and the like, said fluid dispersing apparatus comprising:

a dispersing member having, a landing surface operable to be positioned at an angle with respect to a free flowing column of fluid, and an extension strip extending away from said landing surfce in an intended direction of flow of the fluid at an obtuse angle with respect to said landing surface, said extension strip being fashioned with an arcuate front edge portion when viewed in a plan perspective, and being curved away from the intended direction of travel of the sheet of fluid away from said landing surface extension strip; and means connected to said dispersing member for operably mounting said dispersing member upon a machine adjacent to a source of generally columnar flowing fluid.

2. A fluid dispersing apparatus as defined in claim 1 wherein:

said landing surface being gently concave with respect to the direction of intended receipt of the columnar flowing stream of fluid.

3. A fluid dispersing apparatus as defined in claim 1 wherein:

said extension strip being fashioned with an arcuate upward configuration when viewed in an edge perspective toward said landing surface.

4. A fluid dispersing apparatus as defined in claim 1 and further comprising:

containment means extending away from said landing surface in a direction opposite to the intended direction of flow of the fluid.

5. A fluid dispersing apparatus as defined in claim 4 wherein said containment means includes:

lip means extending generally parallel to but offset from an intended direction of flow of the columnar flowing stream of fluid and perpendicular to an intended direction of flow of the sheet of fluid directed away from said landing surface.

* * * * *